US006647990B2

(12) United States Patent
Shinn

(10) Patent No.: US 6,647,990 B2
(45) Date of Patent: Nov. 18, 2003

(54) CURLING IRON HANDLE

(76) Inventor: Kevin Shinn, 113 Spyglass Dr., Blue Bell, PA (US) 19422

( * ) Notice: Subject to any disclaimer, the term of this patent is extended or adjusted under 35 U.S.C. 154(b) by 0 days.

(21) Appl. No.: 10/126,837

(22) Filed: Apr. 19, 2002

(65) Prior Publication Data

US 2003/0196673 A1 Oct. 23, 2003

(51) Int. Cl.[7] ..... A45D 2/40
(52) U.S. Cl. ..... 132/224; 16/436
(58) Field of Search ..... 132/224, 225, 132/232, 233, 223; 16/421, 430, 431, 436

(56) References Cited

U.S. PATENT DOCUMENTS

| | | | | | |
|---|---|---|---|---|---|
| 209,704 | A | * | 11/1878 | Millspaugh | 16/431 |
| 549,280 | A | | 11/1895 | Thompson | |
| 1,178,029 | A | * | 4/1916 | Schwartz | 132/224 |
| 1,460,654 | A | * | 7/1923 | Huston | 16/431 |
| 1,491,981 | A | | 4/1924 | Brinkman | |
| 1,605,540 | A | * | 11/1926 | Gibney | 132/224 |
| 1,622,834 | A | | 3/1927 | Marcel | |
| 1,648,740 | A | * | 11/1927 | O'Malley | 132/225 |
| 1,719,232 | A | | 7/1929 | Meade | |
| 1,847,479 | A | | 3/1932 | Godefroy | |
| 1,925,504 | A | | 9/1933 | Siegrist | |
| 2,040,982 | A | | 5/1936 | Di-Guangco et al. | |
| 2,077,991 | A | | 4/1937 | Dodd | |
| 2,550,295 | A | | 4/1951 | Price | |
| 3,164,159 | A | | 1/1965 | Recknagel | |
| 4,464,562 | A | | 8/1984 | Takimae | |
| 4,837,892 | A | * | 6/1989 | Lo | 16/431 |
| 5,664,588 | A | | 9/1997 | Berry | |

* cited by examiner

*Primary Examiner*—Todd E. Manahan
(74) *Attorney, Agent, or Firm*—Michael G. Crilly, Esq.

(57) ABSTRACT

The present invention is a curling iron handle comprised of a hand grip having a first end and a second end and at least one guard. Guard extends beyond grip thereby constraining hand movement during curling iron usage. Grip and guard are aligned and rotationally disposed along a shaft extending from each curling element comprising the curling iron. In one embodiment, a single guard is aligned with and contacting one end of the grip. In a second embodiment, a guard is aligned with and contacting each end of the grip. In a preferred embodiment, one guard is fixed to the grip thereby providing a single rotatable unit. A contoured region is provided between grip and guard to prevent discomfort when hand contacts guard.

12 Claims, 3 Drawing Sheets

CURLING IRON HANDLE

CROSS REFERENCE TO RELATED APPLICATIONS

None.

FEDERALLY SPONSORED RESEARCH OR DEVELOPMENT

None.

BACKGROUND OF THE INVENTION

1. Field of the Invention

The present invention generally relates to a handle for curling irons. Specifically, the invention is a handle constraining hand movement.

2. Background

Various curling irons are described in the related arts. A typical curling iron consists of a heat element, commonly referred to as a barrel, and a clamp element, or simply clamp, each attached to a shaft and thereafter fastened in a scissor-like arrangement. A handle is rotatably disposed about each shaft. Temperature within the heat element is regulated via electrical and non-electrical means.

Curling iron use requires several steps. The user grasps the iron in one hand so that fingers, thumb, and palm surround both handles. Thereafter, heat and clamp elements are separated by the outward movement of handles. Next, the user secures a lock of hair between heated barrel and clamp elements. Finally, the user rotates the curling iron thereby wrapping the lock around both elements. Coordinated movement of fingers, thumb, and palm rotates the iron in a circular fashion within the confines of the hand. Heat within the heat element is applied to the lock thereby maintaining a curl after iron is removed.

Three disadvantages are noteworthy with respect to the related arts. First, the natural orientation of thumb and fingers about the handles results in relative movement between hand and handles in the direction of the curling elements when iron is rotated opposite to the direction of the thumb. Unconstrained hand movement may cause contact between heated curling elements and hand resulting in injury. Second, the natural orientation of thumb and fingers about the handles results in relative movement between hand and handle in the direction opposite to the curling elements when curling iron is rotated in the direction of the thumb. Unconstrained hand movement results in a separation between hand and curling iron causing hand to slip from handle. Third, the unrestrained movement of hand along handle length frustrates both control and balance of the iron during use, namely by placing hand either too close to or too far from the curling elements. Currently, the user avoids the noted disadvantages by limiting rotation of the curling iron or interrupting rotation so to adjust hand position along the handle length.

What is required is a handle design constraining hand movement along the handle length. What is also required is a handle preventing contact between hand and heated elements comprising the curling iron. Furthermore, what is required is a handle maintaining control and balance of curling iron during use.

SUMMARY OF THE INVENTION

An object of the present invention is to provide a safer, as well as, better controlled curling iron.

The present invention is comprised of a grip having a guard disposed at one distal end. The guard is a washer-shaped element extending beyond the outer diameter of the grip. In a preferred embodiment, guard is in intimate contact with the distal end closest to curling elements, namely barrel and clamp. In an alternate embodiment, a guard is provided at both distal ends along the handle. In a preferred embodiment, guards are fixed to the grip, thereby rotating as a single unit. Grip and guard are composed of a thermally non-conductive or minimally conductive material, preferably a phenolic.

Several advantages are offered by the present invention. Handle constrains hand movement to the grip segment thereby avoiding injury by preventing contact between hand and curling elements. Handle constrains hand movement to the grip thereby improving contact between hand and handle and maintaining the controlled movement of iron. Handle constrains hand movement to the handle length thereby preventing lose of contact between hand and handle.

BRIEF DESCRIPTION OF THE DRAWINGS

The invention will now be described in more detail, by way of example only, with reference to the accompanying drawings, in which.

REFERENCE NUMERALS

Figure 1:
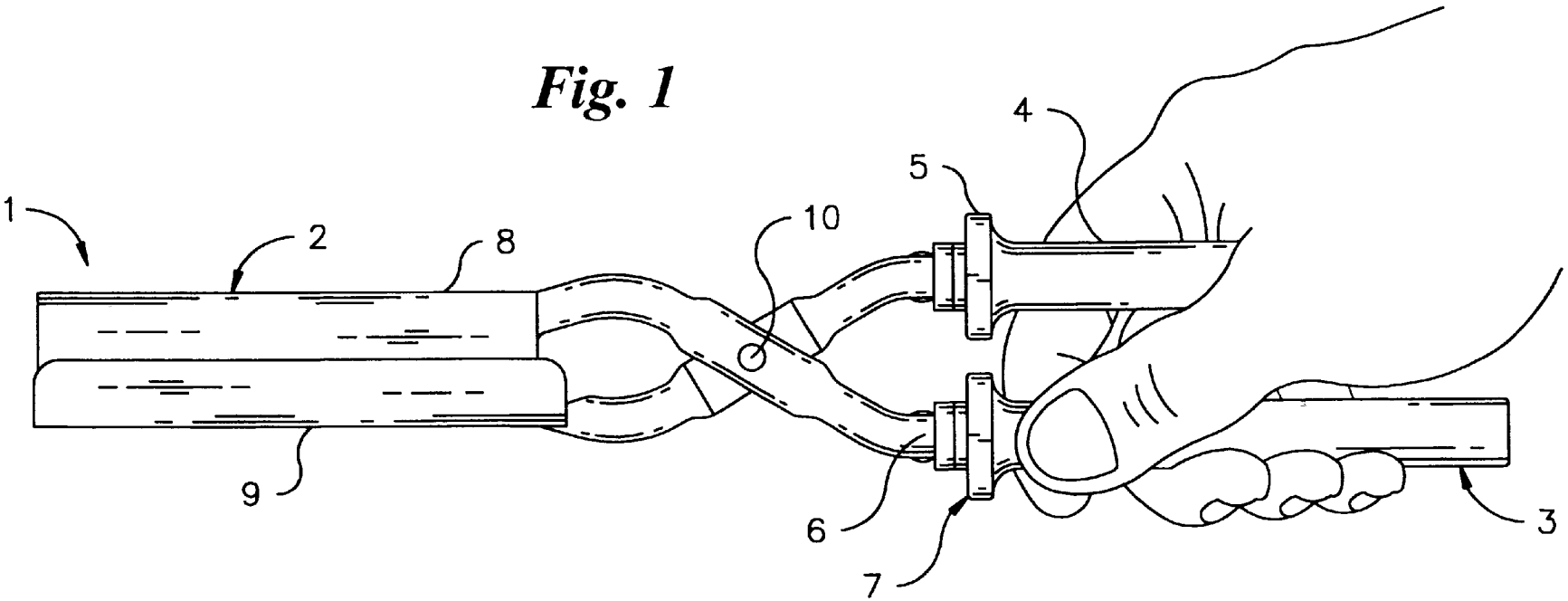
FIG. 1 is a elevation view of the present invention showing hand grasping handle.

1 Curling iron
2 Curling elements
3 Handle elements
4 Grip
5 Guard
6 Shaft
7 Handle
8 First curling element
9 Second curling element
10 Hinge
11 First end
12 Second end
13 Longitudinal axis
14 Radial differential
15 Transition
16 Guard diameter

DESCRIPTION OF THE INVENTION

FIG. 1 shows the present invention grasped by thumb, fingers, and palm along a pair of handle elements 3. A single guard 5 is fixed to each handle 7 thereby preventing said hand from contacting curling elements 2 as hand slides along the grip 4.

A typical curling iron 1 is comprised of a pair of curling elements 2, namely a first curling element 8 and a second curling element 9 each having a shaft 6, preferably cylindrical, extending from one end. Curling elements 2 include barrels, u-shaped clamps, and other designs known within the art. Curling elements 2 and shafts 6 are arranged in a scissor-like fashion about a hinge 10, as understood in the art. A handle 7 is attached to each shaft 6.

Figure 2:
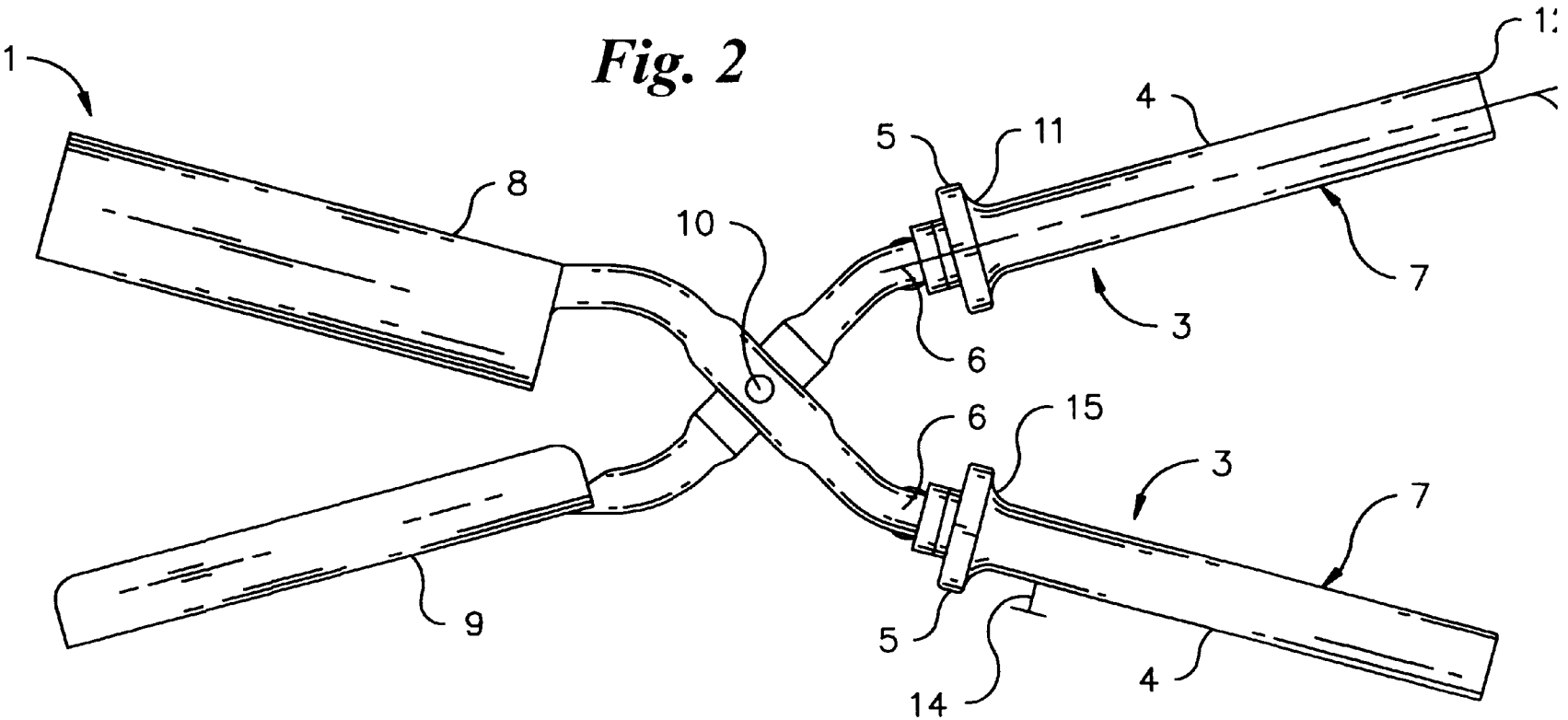
FIG. 2 is an elevation view of curling iron showing handle comprised of grip with a guard fixed at one end.

In the present invention, the handle 7 is comprised of a grip 4 and a guard 5 fixed to the grip 4, as shown in FIG. 2. A typical grip 4 is a cylindrical-shaped or nearly-cylindrical-shaped element having a first end 11 and a second end 12 and rotatably disposed about a shaft 6 aligned along the longitudinal axis 13 of the handle 7. However, the grip 4 may include a variety of shapes capable of supporting a hand. Furthermore, the grip 4 should be of sufficient length to accommodate at least one hand width.

The guard 5 is a washer-shaped, nearly-washer-shaped, or similar element rotatably disposed about the shaft 6 and axially aligned with and contacting the grip 4. Functionally, the guard 5 constraints sliding movement of the hand along the grip 4. Therefore, the guard 5 should extend radially outward beyond the outer diameter of the grip 4. Preferably, the radial differential 14 between grip 4 and guard 5 should be sufficient to prevent hand movement over the guard 5. For example, a radial differential 14 of at least a quarter-inch is sufficient to constrain hand movement in many applications.

In preferred embodiments, a transition 15 is provided between grip 4 and guard 5. A typical transition 15 is a frustum-shaped body, as shown in FIG. 2. The transition 15 provides a smooth interface between grip 4 and guard 5, thereby preventing discomfort to hand when contacting guard 5. The transition 15 may be disposed along grip 4 or guard 5 or both grip 4 and guard 5.

Figure 3:
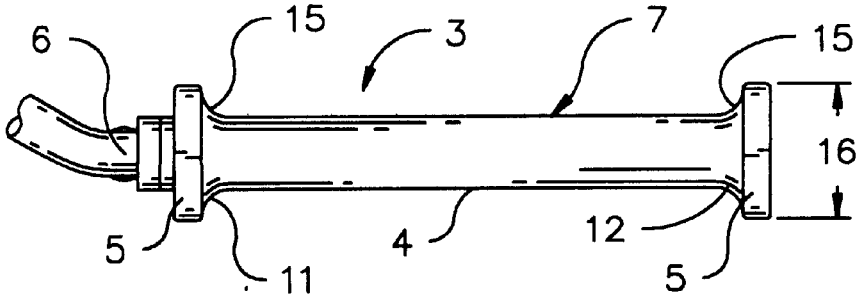
FIG. 3 is an elevation view of curling iron showing handle comprised of grip with a guard fixed at both ends.

In an alternate embodiment, a pair of guards 5 are fixed to the grip 4. FIG. 3 shows a guard 5 contacting a first end 11, as well as a guard 5 contacting a second end 12 along a single grip 4. Guards 5 are typically washer-shaped structures having a diameter larger than the grip 4. However, the guard 5 might consist of a nearly circular, an ellipse, or other functionally equivalent shape. Guard diameter 16 is application dependent and may vary by location. In the present embodiment, a hand rests along the grip 4 between guards 5 thereby preventing hand from extending beyond the handle 7.

Figure 4:
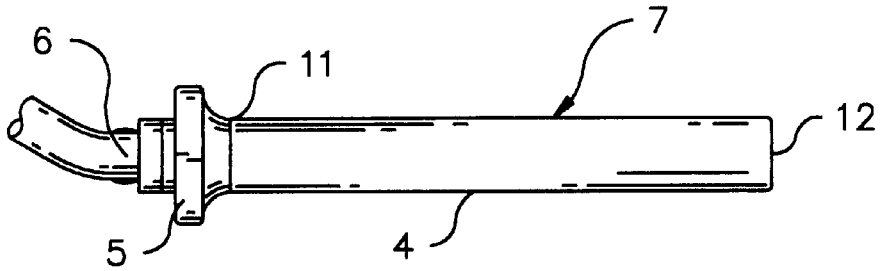
FIG. 4 is an elevation view of curling iron showing two-part handle comprised of a grip and guard separately rotatable about a shaft.
Figure 5:
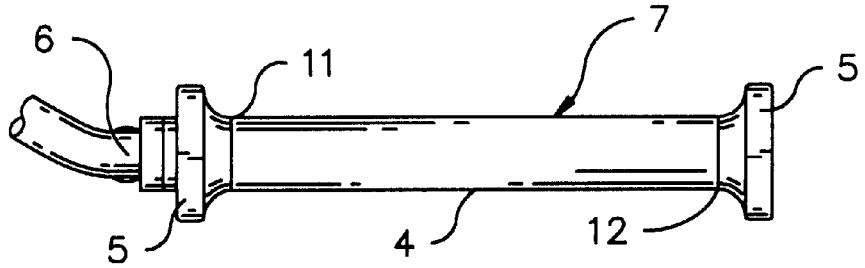
FIG. 5 is an elevation view of curling iron showing three-part handle comprised of a grip and two guards separately rotatable about a shaft.

FIGS. 4 and 5 show two additional embodiments wherein guard 5 contacts the grip 4 in a non-fixed fashion. Mechanical stops and/or fasteners, as understood in the art, are located at both ends of the shaft 6 contacting the guards 5 opposite to the grip 4 thereby maintaining sliding contact between grip 4 and guard 5 during rotation. In both embodiments, the grip 4 rotates separately from the guard 5, unlike embodiments in FIGS. 2 and 3 wherein grip 4 and guard 5 rotate as a unitary unit.

Handle 7 components, namely grip 4 and guard 5, are composed of one or more thermal resistive materials including plastics, ceramics, and wood, as well as other materials understood in the art. The preferred embodiment is composed of a phenolic. Grip 4 and guard 5 are fabricated via methods understood in the art, including but not limited to machining, molding, and injection molding.

The description above indicates that a great degree of flexibility is offered in terms of the apparatus. Although the present invention has been described in considerable detail with reference to certain preferred versions thereof, other versions are possible. Therefore, the spirit and scope of the appended claims should not be limited to the description of the preferred versions contained herein.

What is claimed is:

1. A curling iron handle comprising:

(a) a hand grip having a first end and a second end, said first end adjacent to a curling element; and (b) a guard contacting said first end, said guard extending radially beyond said hand grip, said guard and said hand grip aligned along and disposed about a shaft extending from said curling element, said guard and said hand grip freely and separately rotatable about said shaft, said hand grip and said guard composed of a heat resistant material.

2. The curling iron handle of claim 1, further comprising a transition disposed along said guard and said grip.

3. A curling iron handle comprising:

(a) a hand grip having a first end and a second end, said first end adjacent to a curling element; and (b) a guard attached to said first end, said guard extending radially beyond said hand grip, said guard and said hand grip aligned along and disposed about a shaft extending from said curling element, said guard and said hand grip freely rotatable about said shaft, said hand grip and said guard composed of a heat resistant material.

4. The curling iron handle of claim 3, further comprising a transition disposed along said guard and said grip.

5. A curling iron handle comprising:

(a) a hand grip having a first end and a second end, said first end adjacent to a curling element;

(b) a first guard attached to said first end, said first guard extending radially beyond said hand grip; and (c) a second guard contacting said second end, said second guard extending radially beyond said hand grip, said first guard, said second guard and said hand grip aligned along and disposed about a shaft extending from said curling element, said hand grip and said first guard freely rotatable together but separately from said second guard also freely rotatable about said shaft, said hand grip, said first guard and said second guard composed of a heat resistant material.

6. The curling iron handle of claim 5, further comprising a transition disposed along said guards and said grip.

7. A curling iron handle comprising:

(a) a hand grip having a first end and a second end, said first end adjacent to a curling element;

(b) a first guard contacting said first end, said first guard extending radially beyond said hand grip; and (c) a second guard contacting said second end, said second guard extending radially beyond said hand grip, said first guard, said second guard and said hand grip aligned along and disposed about a shaft extending from said curling element, said hand grip, said first guard and said second guard freely and separately rotatable about said shaft, said hand grip, said first guard and said second guard composed of a heat resistant material.

8. The curling iron handle of claim 7, further comprising a transition disposed along said guards and said grip.

9. A curling iron handle comprising:

(a) a hand grip having a first end and a second end, said first end adjacent to a curling element;

(b) a first guard contacting said first end, said first guard extending radially beyond said hand grip; and (c) a second guard attached to said second end, said second guard extending radially beyond said hand grip, said first guard, said second guard and said hand grip aligned along and disposed about a shaft extending from said curling element, said hand grip and said second guard freely rotatable together but separately from said first guard also freely rotatable about said shaft, said hand grip, said first guard and said second guard composed of a heat resistant material.

10. The curling iron handle of claim 9, further comprising a transition disposed along said guards and said grip.

11. A curling iron handle comprising:

(a) a hand grip having a first end and a second end, said first end adjacent to a curling element;

(b) a first guard attached to said first end, said first guard extending radially beyond said hand grip; and (c) a second guard attached to said second end, said second guard extending radially beyond said hand grip, said first guard, said second guard and said hand grip aligned along and disposed about a shaft extending from said curling element, said first guard, said second guard, and said hand grip freely rotatable together about said shaft, said hand grip, said first guard and said second guard composed of a heat resistant material.

12. The curling iron handle of claim 11, further comprising a transition disposed along said guards and said grip.

* * * * *